US007669727B2

(12) United States Patent
Hubbard

(10) Patent No.: US 7,669,727 B2
(45) Date of Patent: Mar. 2, 2010

(54) BAG SUPPORT SYSTEM

(75) Inventor: John Dana Hubbard, Billerica, MA (US)

(73) Assignee: Millipore Corporation, Billerica, MA (US)

( * ) Notice: Subject to any disclaimer, the term of this patent is extended or adjusted under 35 U.S.C. 154(b) by 837 days.

(21) Appl. No.: 10/513,540

(22) PCT Filed: Apr. 2, 2004

(86) PCT No.: PCT/US2004/011678

§ 371 (c)(1),
(2), (4) Date: Nov. 5, 2004

(87) PCT Pub. No.: WO2005/026019

PCT Pub. Date: Mar. 24, 2005

(65) Prior Publication Data

US 2005/0252914 A1 Nov. 17, 2005

(51) Int. Cl.
*B65D 1/42* (2006.01)
*B65D 3/22* (2006.01)
*B65D 81/09* (2006.01)

(52) U.S. Cl. ..... 220/62.15; 206/522; 206/584; 220/9.4; 220/62.21; 220/495.06

(58) Field of Classification Search ..... 220/62.15, 220/9.4, 495.06, 62.18, 62.21, 592.05, 592, 220/27; 383/104, 105, 109; 206/522, 584
See application file for complete search history.

(56) References Cited

U.S. PATENT DOCUMENTS 2,513,749 A * 7/1950 Schilling ..... 62/45.1
2,967,152 A * 1/1961 Matsch et al. ..... 252/62
3,144,160 A * 8/1964 Johnson et al. ..... 220/592.23
3,162,330 A 12/1964 Dickson et al.
3,410,443 A * 11/1968 Hofmann ..... 220/592.21
3,695,483 A * 10/1972 Pogorski ..... 220/592.26
3,698,588 A * 10/1972 Pogorski ..... 220/592.26
5,107,782 A * 4/1992 Frederick ..... 114/74 R
5,180,060 A * 1/1993 Forti et al. ..... 206/522
5,407,090 A * 4/1995 Boots ..... 220/62.18
6,015,057 A * 1/2000 Stone et al. ..... 220/9.2

(Continued)

FOREIGN PATENT DOCUMENTS

FR 2 708 573 A 2/1995

(Continued)

OTHER PUBLICATIONS

International Search Report, Sep. 3, 2004.

*Primary Examiner*—Anthony Stashick
*Assistant Examiner*—Niki M Eloshway

(57) ABSTRACT

The present invention provides a support system (6) for biobags (2) or disposable manufacturing components that uses one or more channels (20) filled with one or more types and/or sizes of media (13). The media (13) is fluid at atmospheric pressure but becomes rigid when under less than atmospheric conditions. The channels (20) conform to one or more edges and/or surfaces of the support and preferably one or more transverse ribs (26) connect them together. A vacuum is applied to the media (13) in the channels removing the air, compacting the media together and rendering the media in the channel(s) rigid and self-supporting. Supports can be designed as part of the disposable biobag (2) or as a separate item which surrounds at least a portion of the biobag.

10 Claims, 5 Drawing Sheets

U.S. PATENT DOCUMENTS

| | | | | |
|---|---|---|---|---|
| 6,168,040 | B1 * | 1/2001 | Sautner et al. | 220/592.1 |
| 6,196,719 | B1 * | 3/2001 | Brown | 383/109 |
| 2003/0121963 | A1 * | 7/2003 | Van Handel | 229/403 |
| 2006/0219723 | A1 * | 10/2006 | Wang | 220/592.27 |

FOREIGN PATENT DOCUMENTS

| | | |
|---|---|---|
| JP | 2-98580 | 4/1990 |
| JP | 10-110416 | 4/1998 |
| JP | 2002-337939 | 11/2002 |
| WO | WO 93/06027 A | 4/1993 |

* cited by examiner

BAG SUPPORT SYSTEM

The present invention relates to a support system for disposable containers. More particularly, it relates to a disposable support system for containers in the biotech industry.

BACKGROUND OF THE INVENTION

Traditional biotech systems, such as bioreactors, mixing tanks, storage tanks and associated plumbing fixtures have been made of stainless steel. It is the material of choice as it is capable of withstanding a wide range of temperatures, pressures, pH, etc without leaching anything back into the system. More importantly, it is capable of being cleaned in place with steam and/or a caustic solution so as to render the system sterile before reuse.

A drawback is that such equipment is expensive and typically is available in limited sizes. Additionally, the system once assembled is typically fixed in that configuration due to the use of welds and the like to assemble it.

Many biopharmaceuticals need to be manufactured at a relatively small scale and/or low cost. In order to do so, the use of disposable plastic containers and piping has been proposed. While still a nascent industry, the premise is encouraging.

One further issue is that unlike a stainless steel container, a plastic container is typically a plastic bag made of one or more layers of plastic film, is not self supportive and is prone to damage such as punctures and tears.

Various support devices including large heavy gauge plastic containers into which the bag is placed and used or rigid steel or composite scaffolding have been used. In essence, they form an exoskeleton around the bag providing it with the necessary support and some protection against rupture.

As with traditional steel systems, this requires an investment in supports of different sizes and configurations. Additionally, when not in use, these supports take up needed floor space.

What is needed is a compact support system that is less expensive and more universal in its use or applications. The present invention provides such a system.

SUMMARY OF THE INVENTION

The present invention provides a support system for biobags or disposable manufacturing components that uses one or more channels filled with one or more types and/or sizes of media. The media is fluid at atmospheric pressure but becomes rigid when under less than atmospheric conditions.

The channels conform to one or more edges and/or surfaces of the support and preferably one or more transverse ribs connect them together. A vacuum is applied to the media in the channels removing the air, compacting the media together and rendering the media in the channel(s) rigid and self-supporting.

Supports can be designed as part of the disposable biobag or as a separate item which surrounds at least a portion of the biobag.

It is an object of the present invention to provide a self supportive support system for bags comprising a container formed of a film having at least one side wall, one or more channels formed along at least one edge of the at least one side wall, said one or more channels being hollow and capable of being selectively sealed, said one or more channels being filled with a media which is fluid of atmospheric pressure and rigid at less than atmospheric pressure and one or more valves connected to the one or more channels to retain a less than atmospheric pressure within the one or more channels.

It is another object of the present invention to provide a self supportive support system for bags comprising a container formed of a film having at least one side wall, one or more channels formed along at least one edge of the at least one side wall, said one or more channels being hollow and capable of being selectively sealed, said one or more channels being filled with a media which is fluid of atmospheric pressure and rigid at less than atmospheric pressure wherein the media is selected from glass and plastic beads, glass and plastic particles, glass and plastic microspheres, sand, silica, diatomaceous earth, perlite, vermiculite, ground nutshells, metal beads, wood beads, sand, gravel and blends thereof and one or more valves connected to the one or more channels to retain a less than atmospheric pressure within the one or more channels.

It is a further object of the present invention to provide a self supportive support system for bags comprising a container formed of a film having at least one side wall, one or more channels formed along at least one edge of the at least one side wall, said one or more channels being hollow and capable of being selectively sealed, said one or more channels being filled with a media which is fluid of atmospheric pressure and rigid at less than atmospheric pressure, one or more valves connected to the one or more channels to retain a less than atmospheric pressure within the one or more channels and wherein the system can be a separate item from the bag or it can be incorporated into the bag as part of the bag. It is an additional object of the present invention to provide a method of providing a support to a plastic storage bag comprising selecting a plastic bag to be used for storage, providing a support device surrounding at least one of the side walls of the bag, the support being formed of a container formed of a film having at least one side wall, one or more channels formed along at least one edge of the at least one side wall, said one or more channels being hollow and capable of being selectively sealed, said one or more channels being filled with a media which is fluid of atmospheric pressure and rigid at less than atmospheric pressure and one or more valves connected to the one or more channels to retain a less than atmospheric pressure within the one or more channels, applying a less than atmospheric pressure to the space via the one or more channels to remove the air or other gases between the media and render the channels rigid and self-supportive and adding one or components into the bag.

IN THE DRAWINGS

FIG. 6A-E shows alternative embodiments of the present invention in top-down view.

DETAILED DESCRIPTION

Figure 1:
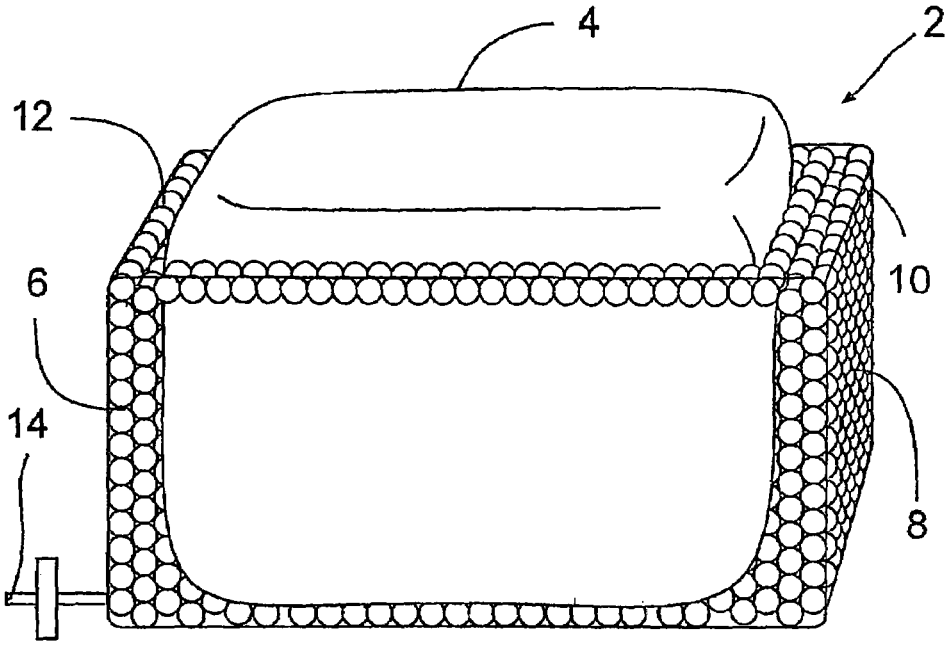
FIG. 1 shows a first embodiment of the present invention in cross sectional view.
Figure 2:
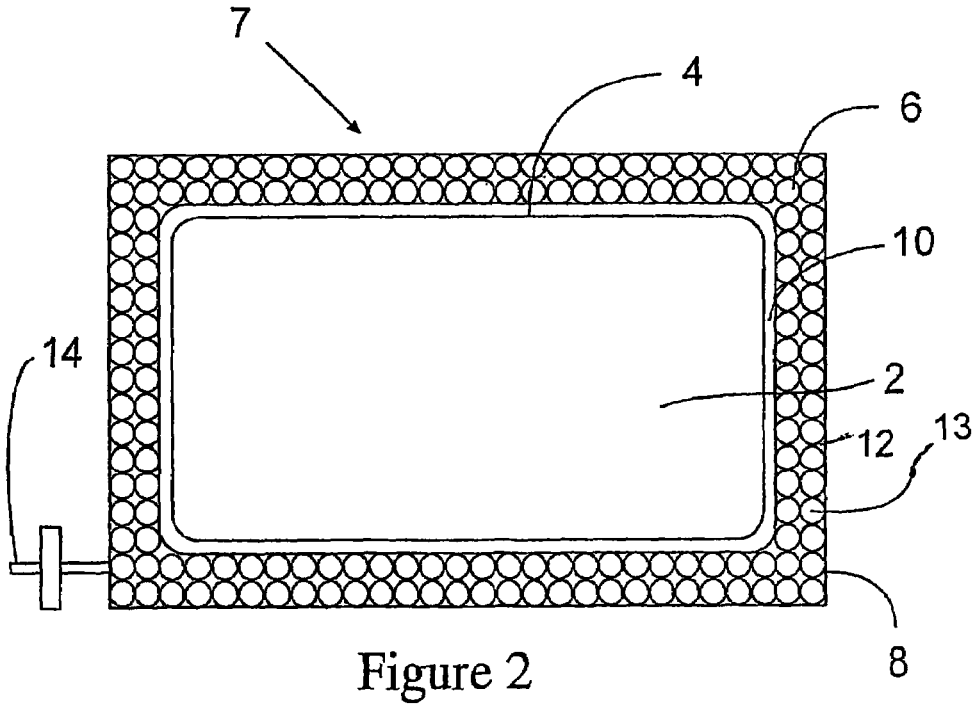
FIG. 2 shows a first embodiment of the present invention in top-down view.

FIGS. 1 and 2 show a first embodiment of the present invention.

In this embodiment, a disposable container 2 such as a plastic bag, for storing a liquid product such as a biopharmaceutical product, or for use as a bioreactor or the like, is surrounded on its vertical sides 4 by a support system 6. As shown, the support system 6 is formed of one or more side wall sections 7, formed of two outer wall layers 8, 10 with a space 12 between. In that space 12 is contained a plurality of media 13, such as beads or other such material. At least one of the outer wall layers, in this example wall layer 8 also has a vacuum port 14 by which an air or other gas within the space 12 can be withdrawn causing the media 13 to compress upon themselves to form a rigid, self-supportive structure for the bag 2 that it surrounds. The port 14 may also be the means for introducing the media 13 into the space 12.

Optionally, the system 6 may have a bottom (not shown) attached to the one or more side walls 7 which may either be a flat sheet of plastic or it may also contain a space filled with media as is done with the side wall 7 structure.

Figure 6A:
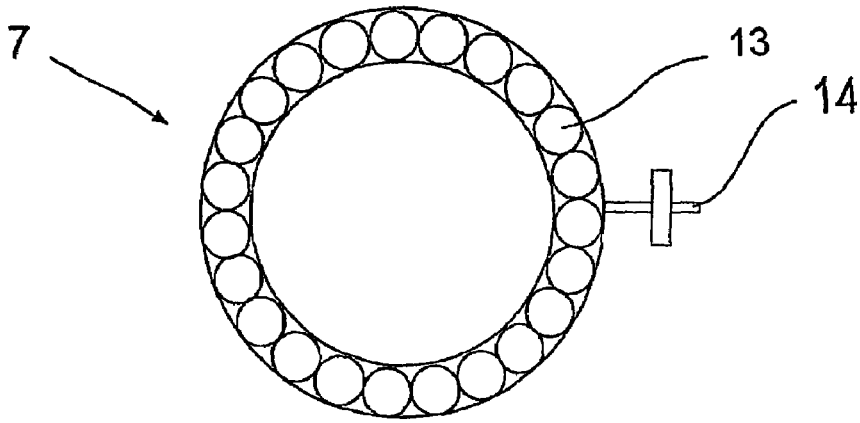
Figure 6B:
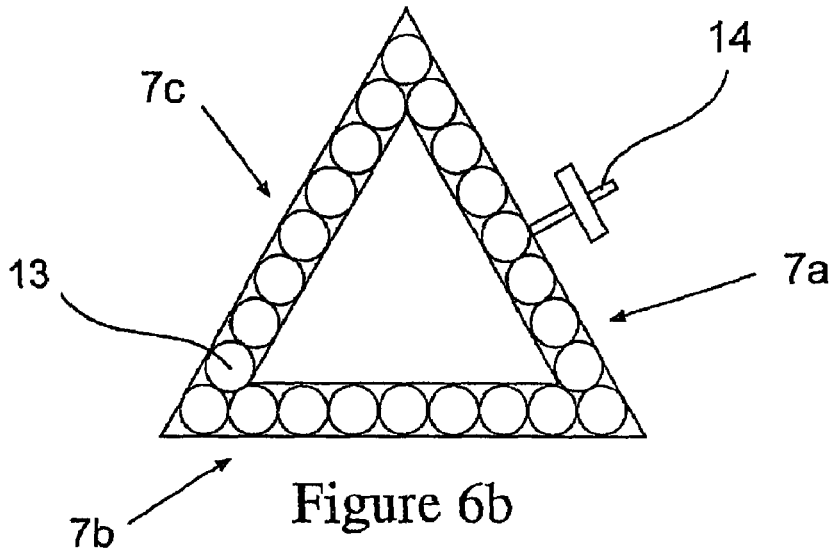
Figure 6C:
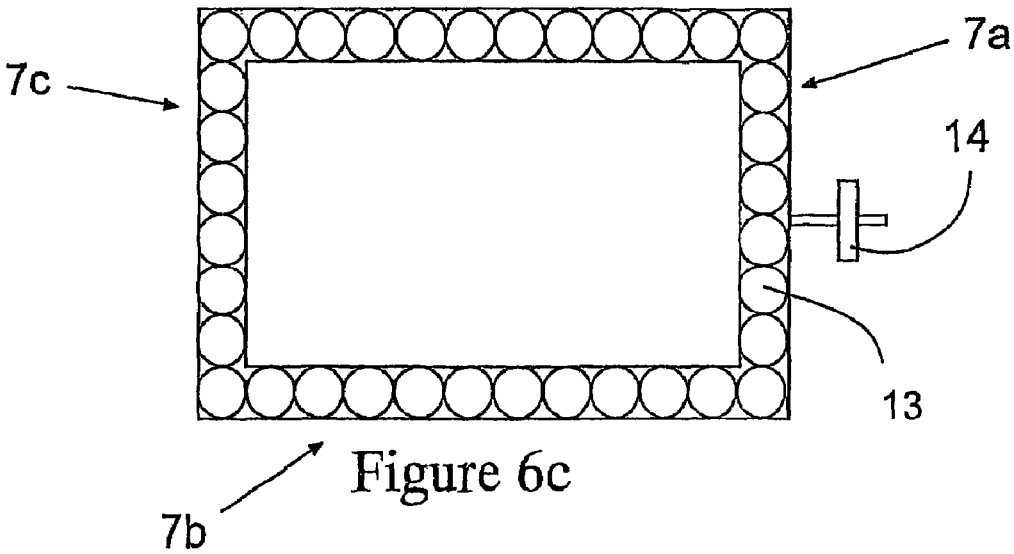
Figure 6D:
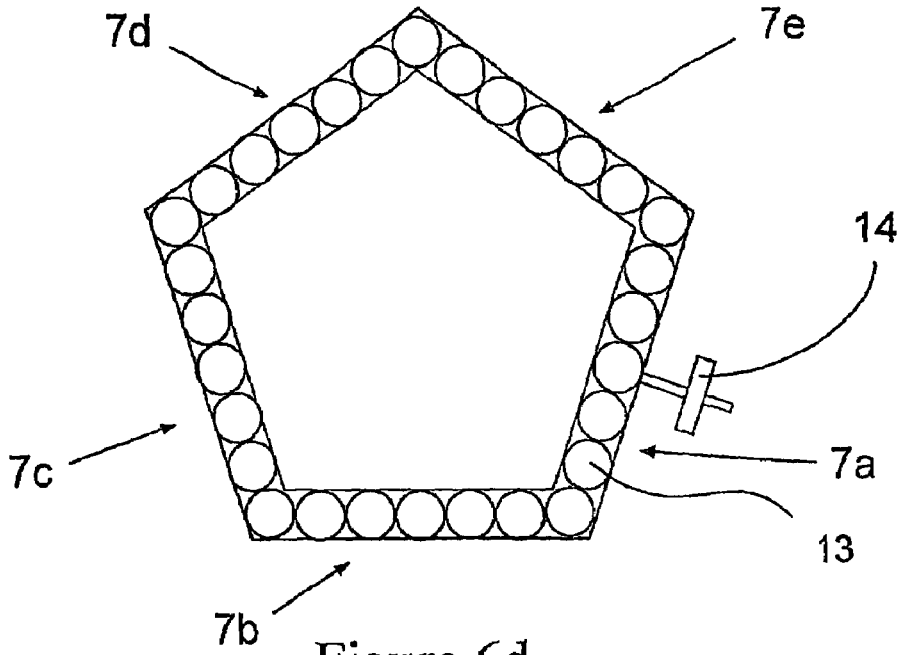
Figure 6E:
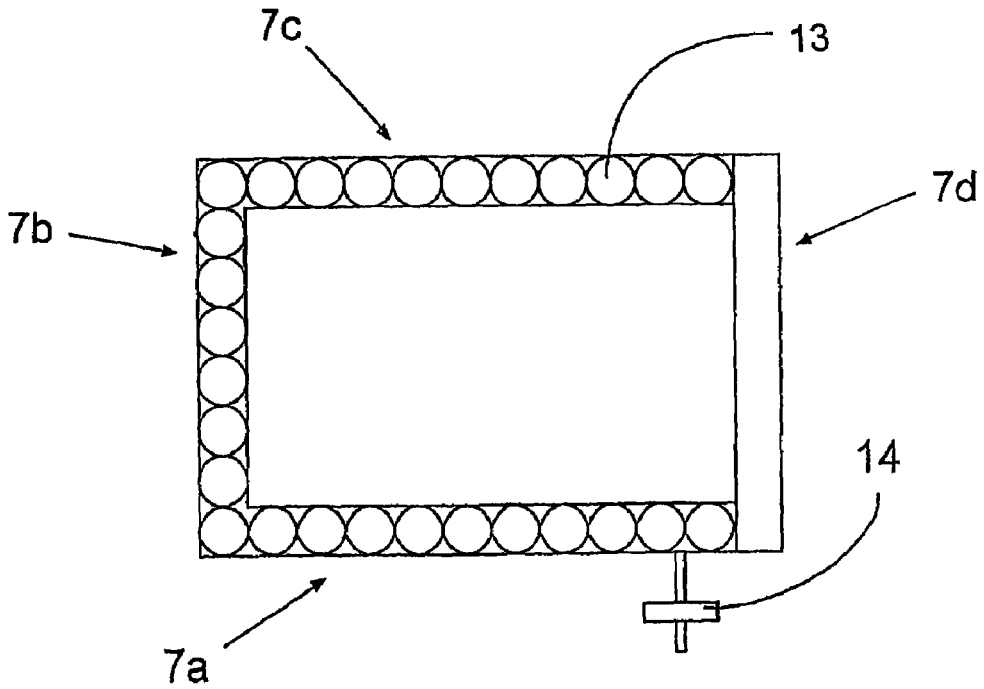

A circular or oval wall design results in one side wall 7 as shown in FIG. 6A. A triangular side wall configuration results in three side walls 7A-C as shown in FIG. 6B. A rectangle or square has four side walls 7A-D as shown in FIG. 6C. A pentagonal design has five 7A-E as shown in FIG. 6D and so on. The number of side wall sections in a given device is determined by the selected shape of the side wall by the designer. In some applications, not all side walls may be filled with media and therefore the number of filled side walls 7A-C may be less than the total number of side walls 7A-D as shown in FIG. 6E where three of the four side walls are filled. The most typical designs of supports in this invention include but are not limited to circular, oval, triangular, rectangular, square, pentagonal, hexagonal and other regular polygonal shapes. Non-conventional shapes may be used if desired or required to conform to the bag it supports.

Figure 3:
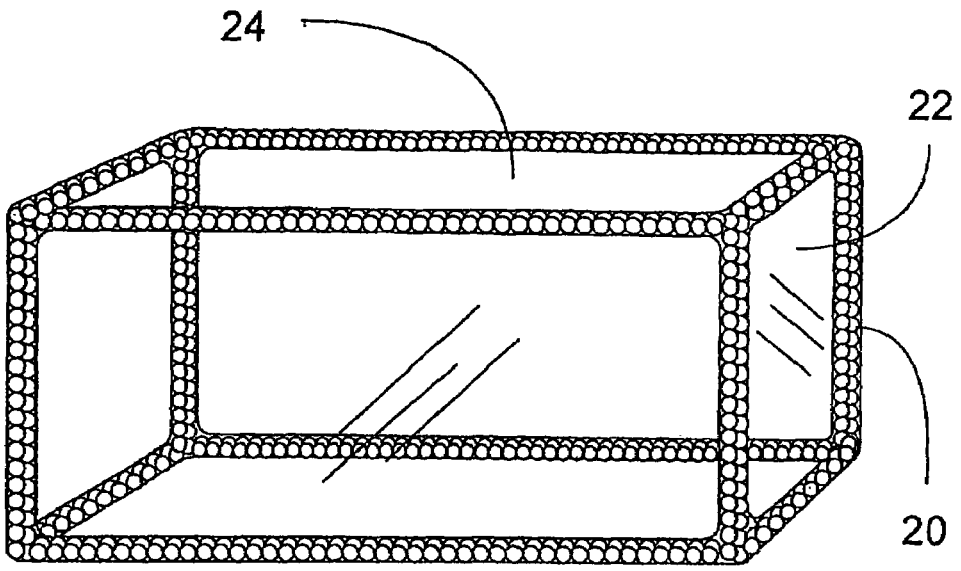
FIG. 3 shows another embodiment of the present invention in planar view.

FIG. 3 shows an alternative embodiment of the present invention. In this embodiment, the media 13 is contained with a series of channels 20 that form a series of ribs around the outer periphery of the system. The side wall areas 22 between the channels 20 are formed of plastic film that are preferably an integral part of the device.

As shown, the top side 24 may be open (having no side wall at all) to allow for insertion of a bag (not shown).

The channels may be interconnected and continuous, one to the other, or they may be two or more separate channels, each with its own vacuum port.

Figure 4:
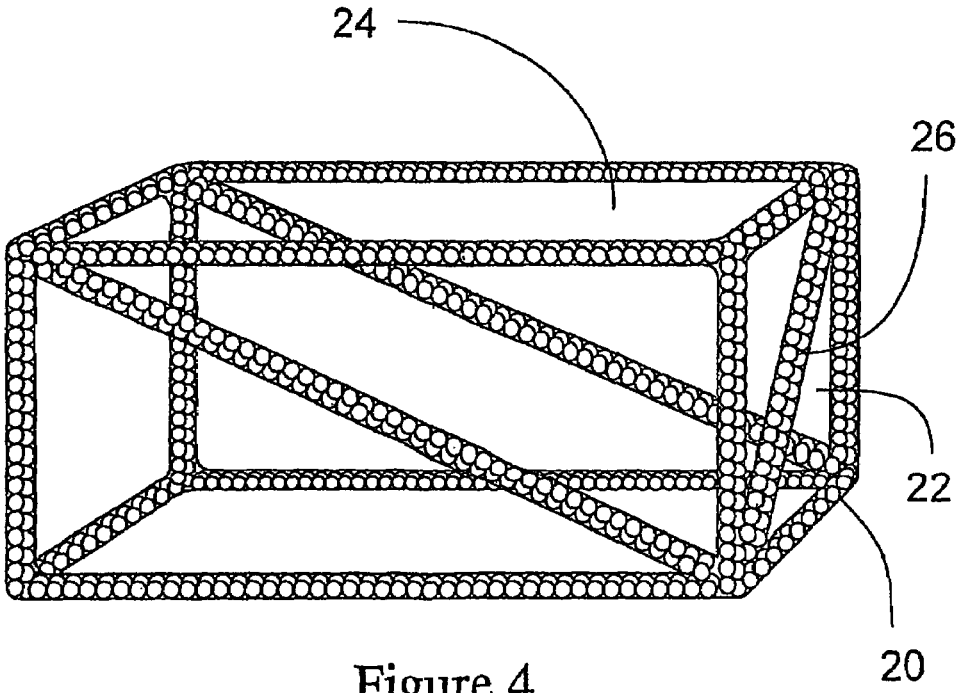
FIG. 4 shows an alternative embodiment of the present invention in planar view.

FIG. 4 shows another embodiment of that of FIG. 3 with a series of one or more transverse ribs 26, also filled with media to provide additional support. Additional support ribs may run perpendicular or at any other desired angle between the two channels one desires to connect. Typically, they will be at the more conventional angles such as 22.5°, 30°, 45°, 60°, or 67.5° from the longer dimension of the channel.

Figure 5:
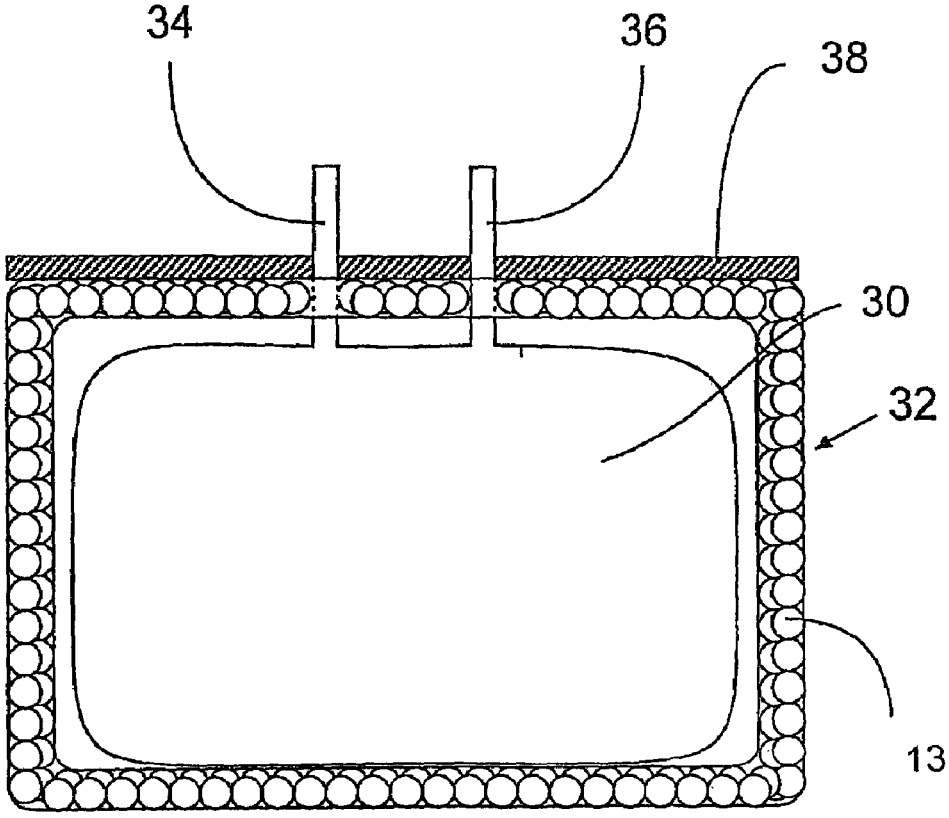
FIG. 5 shows a further embodiment of the present invention in cross sectional view.

FIG. 5 shows another embodiment in which the bag 30 is essentially sealed within the support structure 32. The support structure 32 may take the form of either FIG. 1 or 3. The bag 30 is contained within it and an inlet 34 and outlet 36 to the bag 30 extend through the side 38, in this example the top, of the structure 32. The entire device is then a disposable unit.

Also using the embodiment of FIG. 5 and surrounding the entire bag 30 with media 13, one, in essence, forms an insulated chamber which can either retain heat or cold within the bag 30. Optionally one can select a media that is thermally conductive (e.g. metal beads) to add heat or remove heat from the bag or one can select a bead that is a thermally neutral (styrene beads) to retain heat or cold within the fluid in the bag.

A support device according to the present invention can be made in a variety of ways.

At its simplest form, a bag support structure is formed at the outer peripheral edges of two sheets of plastic by heat sealing the adjacent edges of the two sheets together to form a common space therebetween. A vacuum port is also attached and sealed to at least one of the two layers so as to provide an opening to the space formed between the two layers. This port may also be used to fill the space with media, either before or after shipping to the end user and for evacuating the air from the space before and/or during use.

The ribbed structure such as is shown in FIG. 3 can be formed by several methods.

A first method is to form a tube at the adjacent edges of a sheet of plastic by folding a portion of the plastic back upon itself and heat sealing it to the main body of the plastic sheet.

Alternatively, one can use two sheets of plastic, heat sealing them to each other at their adjoining edges and then again at a selected distance inward from the edge so as to create a tube adjacent the edge.

In a further method, one can extrude a tube that forms the desired rib and then seal it to a plastic sheet which forms the rest of the body of the structure.

Likewise one can simply seal the edges of a smaller to an edge and field of a larger sheet that forms the remainder of the wall of the support device.

The support structure may be made of flexible plastic or rubber. Suitable plastics include polyethylene, polypropylene, PET, EVA copolymers, SBS copolymers, nylons, PVDF, metallocene derived polymers, PTFE resin, thermoplastic elastomers, such as SANTOPRENE® resin and the like. Suitable rubbers can be natural or synthetic such as neoprene or nitrile rubber with or without a fabric reinforcement.

Laminated or coextruded films of two or more layers may also be used to increase strength, provide other properties such as opaqueness and the like.

Films of these are materials are available from a variety of sources including Sealed Air Corporation of New Jersey, E.I. DuPont de Nemours of Wilmington, Del. and Hyclone Inc of Ogden Utah.

Optionally, baffles, subcompartments and other such devices may included in the channels or spaces in order to help keep the media evenly distributed throughout the support.

The media may be in any form that is capable of being compacted sufficiently upon the application of a vacuum so as to form the desired level of rigidity and support. Typically, the media will be in the form of a particle, such as a bead or irregular piece. The size of the media will vary upon its application. It may range in size from 100 microns to 12 mm. Preferably, media is typically of a size from about 0.01 mm to about 6 mm. Preferably, the media is a form that does not cause a puncture or tear of the support by the media.

Optionally, one may use a mixture of different sized media, such as media of two or more different sizes to enhance tighter packing of the media.

The media is preferably incompressible, although media that is compressible may be used provided it ensures that one has the desired rigidity and support during use.

Examples of media that are useful in the present invention, include, but are not limited to plastic or glass beads (hollow or solid) such as polyethylene, polypropylene or styrene beads and borosilicon beads or controlled pore glass, plastic or glass irregularly shaped particles such as may be made by breaking, cutting, chipping, or shattering a block or sheet of plastic or glass into pieces, foamed plastic beads such as foamed styrene beads, metal beads (hollow or solid), wood beads, silica beads and particles, microspheres (glass or plastic), ground nutshells such as walnut, pecan or hickory nutshells, ground corn cob, agarose beads, coarse sawdust, diatomaceous earth, perlite, vermiculite, sand, small gravel and the like.

The supports may be shipped without media, which the user can obtain locally, or they may be shipped with the media already contained within them.

The amount of vacuum applied will depend upon the volume of air to be removed, the media selected, and the level of rigidity and support desired. Typically, a vacuum of from about 0.01 to about 0.5 bar is sufficient.

The system of the present invention may be used in the following manner. A bag to be supported is selected and a support for such a bag is formed by forming one or more side walls having one or more channels formed within it as described above. Media is placed in the one or more channels either during assembly or after assembly of the support (such as through the vacuum port). The bag to be supported is placed within the support so that the support surrounds at least one wall of the bag. A vacuum is applied to the media to withdraw the air and other gases trapped between and/or within the media, rendering it rigid and self-supportive. A material is then put into the bag, such as a liquid or powder.

The present invention is contemplated for use in the disposable pharmaceutical and biopharmaceutical manufacturing industries, especially in contract and small scale manufacturing. It may also be used in other applications such as bulk storage of liquids or solid flowable materials such as powders. These may include water, fuel, powdered foodstuffs and the like. It may also be used in the brewing of beer, mead, and the fermentation of wine, vinegars and hard cider. It may also be used in the mixing of components being used as the bowl for holding the bag into which the ingredients such as paints are mixed or blended. Other applications will also be readily apparent to one of ordinary skill in the art.

What I claim:

1. A support system for bags consisting essentially of a container formed of a flexible, plastic film having at least one side wall, one or more channels formed along at least one edge of the at least one side wall, said one or more channels being hollow and capable of being selectively sealed, said one or more channels being filled with a solid media which is fluid at atmospheric pressure and rigid at less than atmospheric pressure to form a self supportive structure and one or more valves connected to the one or more channels to retain a less than atmospheric pressure within the one or more channels wherein the container has channels formed along the top and bottom edges of the container and one or more interconnecting ribs extend from one edge channel to the other wherein the one or more interconnecting ribs being filled with a solid media which is fluid at atmospheric pressure and rigid at less than atmospheric pressure to form a self supportive structure.

2. The system of claim 1 wherein the media is selected from glass and plastic beads, glass and plastic particles, glass and plastic microspheres, sand, silica, diatomaceous earth, perlite, vermiculite, ground nutshells, metal beads, wood beads, sand, gravel and blends thereof.

3. The system of claim 1 wherein the support is incorporated as part of the bag it supports.

4. The system of claim 1 further comprising a bottom wall.

5. The system of claim 1 further comprising one or more ports in the one or more side walls for entry into the one or more channels.

6. The system of claim 1 wherein the support has two or more side walls.

7. The system of claim 1 wherein the support has three or more side walls.

8. The system of claim 1 wherein the support has four or more side walls.

9. The system of claim 1 wherein the support is separate from the bag it supports.

10. A method of providing a support to a plastic storage bag consisting essentially of selecting a plastic bag to be used for storage, providing a support device surrounding at least one of the side walls of the bag, the support being formed of a container formed of a flexible plastic film having at least one side wall, one or more channels formed along at least one edge of the at least one side wall, said one or more channels being hollow and capable of being selectively sealed, said one or more channels being filled with a solid media which is fluid at atmospheric pressure and rigid at less than atmospheric pressure to form a self supportive structure and one or more valves connected to the one or more channels to retain a less than atmospheric pressure within the one or more channels wherein the container has channels formed alone the top and bottom edges of the container and one or more interconnecting ribs extend from one edge channel to the other wherein the one or more interconnecting ribs being filled with a solid media which is fluid at atmospheric pressure and rigid at less than atmospheric pressure to form a self supportive structure, applying a less than atmospheric pressure to the one or more channels to remove the air or other gases between the solid media and render the channels rigid and self-supportive and adding one or components into the bag.

* * * * *